US009605846B2

(12) United States Patent
Hill et al.

(10) Patent No.: US 9,605,846 B2
(45) Date of Patent: Mar. 28, 2017

(54) APPARATUS AND METHOD FOR RECOVERING OFF-GASES FROM NATURAL GAS DEHYDRATOR

(71) Applicants: D. Jeffrey Hill, Oklahoma City, OK (US); J. Scott Hill, Edmond, OK (US)

(72) Inventors: D. Jeffrey Hill, Oklahoma City, OK (US); J. Scott Hill, Edmond, OK (US)

( * ) Notice: Subject to any disclaimer, the term of this patent is extended or adjusted under 35 U.S.C. 154(b) by 220 days.

(21) Appl. No.: 14/515,323

(22) Filed: Oct. 15, 2014

(65) Prior Publication Data

US 2016/0109121 A1 Apr. 21, 2016

(51) Int. Cl.

| | |
|---|---|
| ***F23G 7/06*** | (2006.01) |
| ***F23D 99/00*** | (2010.01) |
| ***F23N 3/00*** | (2006.01) |
| ***F23N 5/24*** | (2006.01) |

(52) U.S. Cl.

CPC ..... *F23G 7/065* (2013.01); *F23D 91/00* (2015.07); *F23N 3/005* (2013.01); *F23N 5/245* (2013.01); *F23D 2207/00* (2013.01); *F23N 2025/04* (2013.01); *F23N 2035/24* (2013.01)

(58) Field of Classification Search

CPC . F23D 91/07; F23G 7/065; F23G 7/00; F23N 1/00; C10L 3/106

USPC ..... 431/5; 95/193, 179; 562/413, 407

See application file for complete search history.

(56) References Cited

U.S. PATENT DOCUMENTS

| | | | | |
|---|---|---|---|---|
| 4,689,053 | A * | 8/1987 | Heath | B01D 53/263 165/300 |
| 5,536,303 | A | 7/1996 | Ebeling | |
| 5,665,144 | A | 9/1997 | Hill et al. | |
| 7,935,228 | B1 | 5/2011 | Rhodes | |
| 9,334,222 | B2 * | 5/2016 | Kang | B01D 3/007 |
| 2013/0056677 | A1 * | 3/2013 | Bela | B01D 53/1425 252/190 |

* cited by examiner

*Primary Examiner* — Gregory Huson
*Assistant Examiner* — Nikhil Mashruwala
(74) *Attorney, Agent, or Firm* — Dunlap Codding, P.C.

(57) ABSTRACT

An apparatus and method for reclaiming uncondensed hydrocarbons normally exhausted to the atmosphere from a still column of a glycol dehydrator system, and combusting the uncondensed hydrocarbons in a burner assembly of a reboiler after the burner assembly has been ignited by fuel gas.

2 Claims, 1 Drawing Sheet

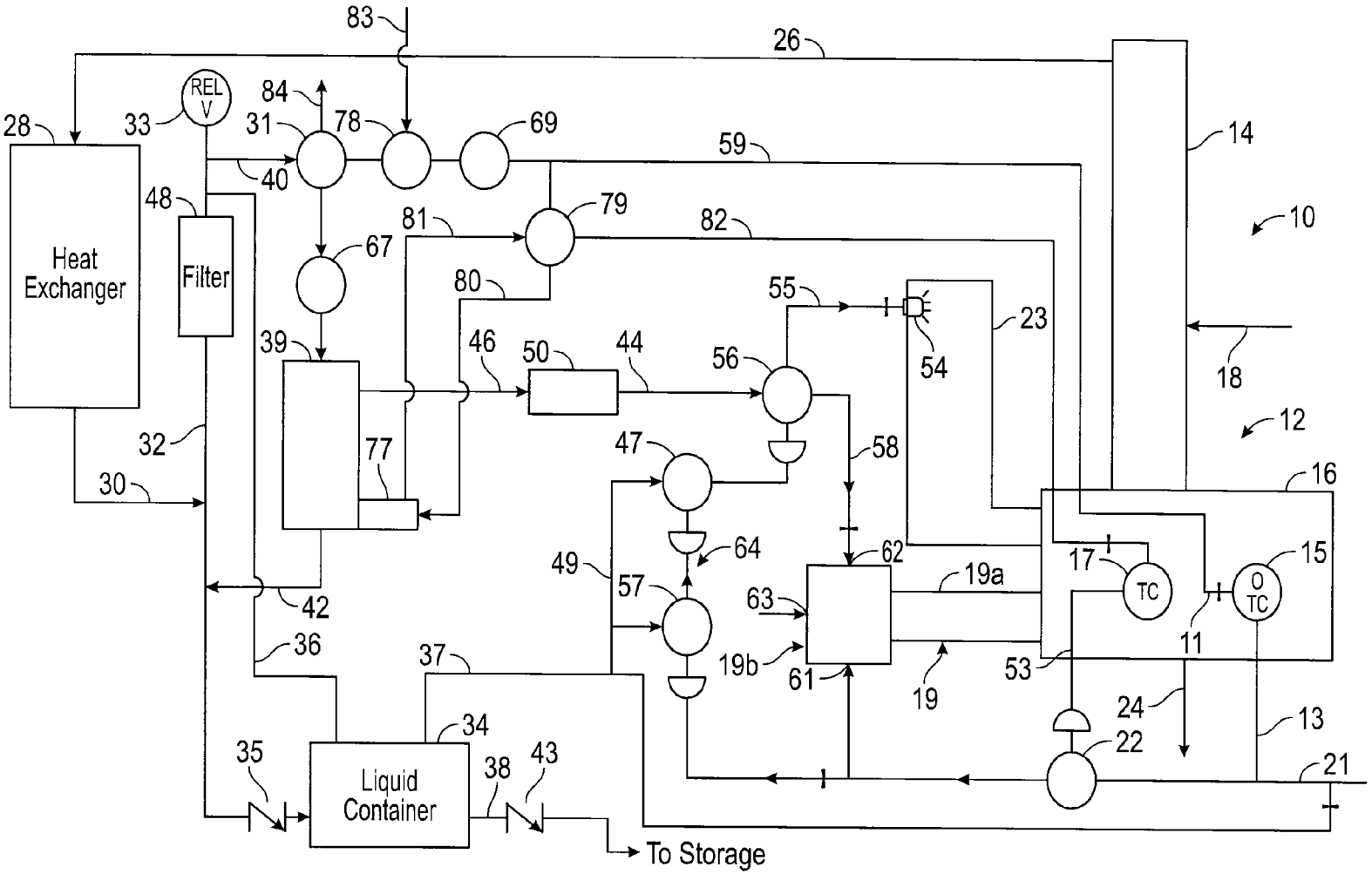
Heat Exchanger
Filter
Liquid Container
To Storage
REL V
TC
O TC

APPARATUS AND METHOD FOR RECOVERING OFF-GASES FROM NATURAL GAS DEHYDRATOR

BACKGROUND

A number of systems exist for dehydrating natural gas to remove water and other liquids from natural gas. Most of these dehydration systems involve passing the natural gas through or in contact with one of a number of known desiccant fluids, such as glycol. For brevity, the desiccant fluid may hereinafter be referred to as glycol, but it should be understood that glycol is only one exemplary desiccant fluid that may be used with such a system. The glycol essentially absorbs the water and other liquids from the natural gas, after which, natural gas is removed from the dehydration system to be sold, or otherwise utilized, and the "wet" glycol is cycled through the system to be regenerated or returned to a "dry" state in which it can be reused to dehydrate more natural gas.

The water and other liquids absorbed by the desiccant often include an amount of off-gases containing contaminants such as volatile organic compounds, known in the art as VOC's, and/or aromatic hydrocarbons, known in the art as BTEX. Such off-gases may be in a gaseous state suspended in the water or other liquids, or may be in liquid state, depending upon temperature, pressure, and/or other conditions. These off-gases are generally pollutants which should not be, and in many cases, may not legally be, released into the environment. These off-gases are generally flammable as well.

A number of attempts have been made to find methods for storing and disposing of such off-gases to prevent them from contaminating the environment. Storage methods may involve routing the off-gases to a tank where they can be held for later disposal. Well sites are often in remote locations, however, where it can be difficult, time-consuming, and expensive to periodically retrieve the off-gases for disposal. Additionally, storage tanks may corrode and begin to leak over time.

Disposal methods have included flares and re-boilers to burn the off-gases, reducing them to combustion byproducts that can more safely be released into the atmosphere. Problems remain, however, for such systems. For example, the off-gases are often mixed in a burner assembly with fuel gas. If the off-gases enter, and collect in, the burner assembly before the burner assembly is properly ignited so as to cause the off-gases to be drawn down to the tip of the burner assembly, a flash back fire may be created upon the ignition of the burner assembly.

To this end, a need exists for a dependable system and method that delays the delivery of the off-gases before they reach the burner assembly until the burner assembly is ignited and brought up to speed. It is to such system and method that the Inventive concepts disclosed herein are directed.

BRIEF DESCRIPTION OF THE DRAWING

The drawing is a schematic illustration of an exemplary apparatus for recovering hydrocarbon pollutants constructed in accordance with the inventive concepts disclosed herein shown in conjunction with a portion of a natural gas dehydration system.

DETAILED DESCRIPTION OF EXEMPLARY EMBODIMENTS

Before explaining at least one embodiment of the inventive concepts disclosed herein in detail, it is to be understood that the inventive concepts disclosed herein are not limited in their application to the details of construction and the arrangement of the components or steps or methodologies set forth in the following description or illustrated in the drawings. The inventive concepts disclosed herein are capable of other embodiments or of being practiced or carried out in various ways. Also, it is to be understood that the phraseology and terminology employed herein is for the purpose of description only and should not be regarded as limiting the inventive concepts disclosed and claimed herein in any way.

In the following detailed description of embodiments of the inventive concepts, numerous specific details are set forth in order to provide a more thorough understanding. However, it will be apparent to one of ordinary skill in the art that the inventive concepts within the disclosure may be practiced without these specific details. In other instances, well-known features may not be described in detail to avoid unnecessarily complicating the instant disclosure.

As used herein the notation "a-n" appended to a reference numeral is intended as merely convenient shorthand to reference one, or more than one, and up to infinity, of the element or feature identified by the respective reference numeral (e.g., 100*a-n*). Similarly, a letter following a reference numeral is intended to reference an embodiment of the feature or element that may be similar, but not necessarily identical, to a previously described element or feature bearing the same reference numeral (e.g., 100, 100*a*, 100*b*, etc.). Such shorthand notations are used for purposes of clarity and convenience only, and should not be construed to limit the instant inventive concepts in any way, unless expressly stated to the contrary.

Further, unless expressly stated to the contrary, "or" refers to an inclusive "or" and not to an exclusive "or." For example, a condition A or B is satisfied by anyone of the following: A is true (or present) and B is false (or not present), A is false (or not present) and B is true (or present), and both A and B are true (or present).

In addition, use of "a" or "an" is employed to describe elements and components of the embodiments herein. This is done merely for convenience and to give a general sense of the inventive concepts. This description should be read to include one or at least one and the singular also includes the plural unless it is obvious that it is meant otherwise.

Finally, as used herein, any reference to "one embodiment" or "an embodiment" means that a particular element, feature, structure, or characteristic described in connection with the embodiment is included in at least one embodiment. The appearances of the phrase "in one embodiment" in various places in the specification are not all necessarily referring to the same embodiment.

The terms "line" and "piping" as used herein refer to tubular pipes for conducting fluids.

Referring to the drawing, an exemplary apparatus 10 for recovering hydrocarbon pollutants constructed in accordance with the inventive concepts disclosed herein is schematically illustrated in conjunction with a portion of a natural gas dehydration system 12. The natural gas dehydration system 12 may include a re-boiler 16 having an over temperature controller 15 and a thermostatic temperature controller 17. The reboiler 15 includes a still column 14 mounted thereon for receiving wet glycol from a contactor tower (not shown) via a line 18. The reboiler 16 may further contain a burner assembly 19 with a fire-tube 19*a* and an air/gas mixer 19*b* at a proximal end of the fire-tube 19*a*. The burner assembly 19 is supplied with fuel gas by a line 21 having a fuel control valve 22 and terminating in an upstanding exhaust stack 23 for heating the glycol. Dry glycol exits the reboiler 16 via a line 24.

The still column 14 is closed, and water vapor and aromatic hydrocarbon gases pass via a line 26 to an air cooled heat exchanger or vapor condenser 28 where the vapor volume is reduced by condensation.

Liquids flow by gravity from the vapor condenser 28 through a drain line 30 to a standpipe 32 which drains to a self-emptying liquid container 34 through a check valve 35. The upper end portion of the standpipe may include pressure relieve valve 31 and a vent valve 31 normally open. Air vapor or gas displaced by liquid entering the liquid container 34 is vented to the upper end portion of the stand pipe 32 via a line 36. The self-emptying liquid container 34 is fully disclosed in U.S. Pat. No. 4,948,010, which is hereby incorporated herein by reference. The container 34 is connected with the fuel gas line 21 via an instrument supply line 37 so that a float (not shown) within the container 34 opens an internal valve (also not shown) when the float is lifted to a predetermined level by contained liquid to allow gas pressure from the instrument supply line 37 to discharge contained liquid to storage through a check valve 43 in a drain line 38.

Hydrocarbon vapors leaving the vapor condenser 28 are filtered by a filter 48 interposed in the standpipe 32. Vapor and aromatic hydrocarbon gases in the upper end portion of the standpipe 32 pass through the vent valve 31 to a separator 39 via a line 40. A manual ball valve 67 may be interposed in the line 40. Condensed liquids in the separator 39 drain by gravity through a line 42 to the depending end portion of the stand pipe 32 and to the liquid container 34. The separator 39 may be provided with a high liquid level shut down 77, which is connected to a high liquid level shut-down reset valve 79 to prevent liquids being passed to the burner assembly 19.

Hydrocarbons leaving the separator 39 pass through a line 44 connected to the burner assembly 19 through a three way control valve 56. A flame arrestor 50 is interposed in the conduit 44 upstream of the three way control valve 56. A branch line 55 extending from the three way control valve 56 to diverts vapors under certain conditions, as presently explained, to the exhaust stack 23. The terminal end of the branch line 55 may include an igniter 54, such as a glow plug, for igniting vapors passed through the branch line 55.

The over temperature controller 15 is connected with the fuel gas supply 21 upstream from the valve 22 by a line 13. During normal operation, over temperature controller 15 supplies fuel gas to the temperature controller 17 via line 59 and 82 to operate valves 22, 57, 47, and 56. The reset valve 79 is interposed in the line 82. Line 59 connects the line 11 to the vent valve 31 via a pilot valve 78. The pilot valve 78 controls the passage of instrument supply pressure via a line 83, which may be fluidly connected to the line 21. A manual block and bleed valve 69 may be interposed in line 69. In the event of reboiler temperature exceeding a predetermined limit, the over temperature controller 15 shuts off gas supply pressure to the thermostat temperature controller 17, the reset valve 79, and the pilot valve 78, thus closing the reset valve 79, the pilot valve 78, and the fuel supply valve 22, which in turn causes the vent valve 31 to move to a position that vents vapors to atmosphere via line 84 and causes the three way control valve 56 to move to a position that directs vapors to the exhaust stack 23 in a manner to be discussed below.

The air/gas mixer **19*b* has a fuel inlet 61 connected with the fuel line 21, a vapor inlet 62 connected to a line 58, and an air inlet 63. A suitable burner assembly 19** is disclosed in U.S. Pat. No. 5,665,144, which is hereby expressly incorporated herein by reference.

As discussed above, the off-gases are often mixed in the burner assembly 19 with fuel gas. If the off-gases enter, and collect in, the air/gas mixer **19*b* before the burner assembly 19 is properly ignited, a flash back fire may be created upon the ignition of the burner assembly 19. To this end, a need exists for a dependable system and method that delays the delivery of the off-gases to the burner assembly 19 until the burner assembly 19** is ignited and brought up to speed.

In one embodiment, the three way control valve 56 is controlled by the pressure of the gas in the fuel line 21 in a way that delays the delivery of the vapors to the vapor inlet 62 until the burner assembly 19 is supplied fuel gas from the fuel line 21 at a preselected pressure and ignited by the fuel gas passed through the fuel inlet 61 and mixed with air from the air inlet 63. In particular, the apparatus 12 further includes a control assembly 64 that includes a throttling pilot valve 57 fluidly connected to the fuel line 21 and a snap pilot valve 47 interposed in an instrument line 49 and fluidly connected to an actuator of the three-way control valve 56. The throttling pilot valve 57 is operably connected between the fuel line 21 and the snap pilot valve 47 so as to place the snap pilot valve 47 in a condition wherein the snap pilot valve 47 directs instrument supply pressure from the instrument line 49 to the actuator of the three way control valve 47.

In one embodiment, the three way control valve 56 is normally positioned to direct vapors through the bypass line 55. The throttling pilot valve 58 may begin to operate upon receiving a preselected pressure (e.g., 4-5 psig) from the fuel line 21. Upon being actuated, the throttling pilot valve 57 opens to allow for the passage of gas through the throttling pilot valve 57 and interact with the snap pilot valve 47. Upon the snap pilot valve 47 receiving a preselected pressure (e.g., 20-30 psig), the snap pilot valve 47 snaps opens to cause the passing of instrument supply pressure (e.g., approximately 80 psig) from the instrument line 49 to the actuator of the three way control valve 56 so as to operate the three way control valve 56 in a way to cause the three way control valve 56 to direct the flow of non-condensed vapors from the separator 39 into the air/gas mixer **19*b* of the burner assembly 19 when the burner assembly 19** is ignited.

Under normal conditions, the apparatus 10 continuously operates under a predetermined temperature controlled by the temperature controller 17. In the event of a malfunction, such as the temperature rising or falling to a temperature range beyond the setting of the temperature control, the over temperature controller 15 closes thereby shutting off instrument supply pressure to the pilot valve 78 and the reset valve 79. As such, the vent valve 31 is caused to move to a position that vents vapors to atmosphere via line 84, and the burner valve 22 is caused to close so as to cause the three way control valve 56 to move so as to direct uncondensed hydrocarbon vapors to the exhaust stack 23 via the bypass line 55. Uncondensed hydrocarbon gases diverted to the exhaust stack are mingled with the thermal draft in the presence of the igniter 54.

From the above description, it is clear that the inventive concepts disclosed herein are adapted to carry out the objects and to attain the advantages mentioned herein as well as those inherent in the inventive concepts disclosed herein. While exemplary embodiments of the inventive concepts disclosed herein have been described for purposes of this disclosure, it will be understood that numerous changes may be made which will readily suggest themselves to those skilled in the art and which are accomplished within the scope of the inventive concepts disclosed herein and defined by the appended claims.

What is claimed is:

1. An apparatus for recovering water and hydrocarbon gases evaporated from glycol in a still column mounted on a re-boiler having a burner assembly with a fire-tube and an air/gas mixer at one end of the fire tube, the air/gas mixer having a fuel inlet, a vapor inlet and an air inlet, the apparatus comprising:

a water and hydrocarbon gas vapor condenser connectable downstream from the still column including separate outlets for water and condensed hydrocarbons and uncondensed hydrocarbons;

an uncondensed hydrocarbons separator downstream from the vapor condenser and having separate outlets for water and condensed hydrocarbons and uncondensed hydrocarbons;

a self-emptying container downstream from the water and condensed hydrocarbons outlet of the vapor condenser and said separator;

a hydrocarbon vapor conduit extending from the separator for conveying non-condensed hydrocarbons to the burner assembly; and a three-way control valve interposed in the hydrocarbon vapor conduit for directing the flow of non-condensed vapors from the condensate separator into the air/gas mixer of the burner assembly when the burner assembly is ignited; and a control assembly for controlling the three way control valve in a way that non-condensed vapors are directed to the burner assembly only after the burner assembly has been ignited by fuel gas passed through the fuel inlet and mixed with air from the air inlet.

2. The apparatus of claim 1, wherein the three way control valve has an actuator, and wherein the control assembly comprises:

a throttling pilot valve fluidly connected to the fuel inlet line; and a snap pilot valve interposed in an instrument line fluidly connected to the three-way valve, wherein the throttling pilot valve is operably connected between the fuel line and the snap pilot so as to place the snap pilot valve in a condition wherein the snap pilot valve directs pressurized fluid from the instrument line to the actuator of the three way control valve at a pressure sufficient to place the three way control valve in a condition wherein the hydrocarbon vapors are directed to the air/gas mixer of the burner assembly via the vapor inlet upon the throttling pilot valve receiving a selected pressure from the fuel line.

* * * * *